US005744766A

United States Patent [19]

Sambar et al.

[11] Patent Number: 5,744,766

[45] Date of Patent: Apr. 28, 1998

[54] SLIDE OR RECIPROCATING SWITCH WITH S-SHAPED BRIDGING-OR SPANNER CONTACT

[75] Inventors: Homer S. Sambar, Shorewood; Frank J. Graninger; Roger E. Karweik, both of Norway, all of Wis.

[73] Assignee: Allen-Bradley Company, Inc., Milwaukee, Wis.

[21] Appl. No.: 685,736

[22] Filed: Jul. 24, 1996

[51] Int. Cl.[6] ..... H01H 15/06; H01H 1/20

[52] U.S. Cl. ..... 200/16 A; 200/243; 200/275

[58] Field of Search ..... 200/11 DA, 11 G, 200/16 A, 243, 275, 5 A, 532

[56] References Cited

U.S. PATENT DOCUMENTS

| | | | |
|---|---|---|---|
| 3,175,067 | 3/1965 | Barcus | 200/243 |
| 3,506,795 | 4/1970 | Schmidt | 200/16 A X |
| 3,641,286 | 2/1972 | Berezowski | 200/5 A |
| 3,809,838 | 5/1974 | Coppola | 200/532 |
| 3,812,312 | 5/1974 | Andersen | 200/16 D X |
| 4,203,013 | 5/1980 | Serras-Paulet | 200/5 A |
| 5,315,077 | 5/1994 | Simon et al. | 200/11 R |

*Primary Examiner*—J. R. Scott

*Attorney, Agent, or Firm*—Joseph N. Ziebert; John M. Miller; John J. Horn

[57] ABSTRACT

A device and method establishing an electrically conductive path between a pair of contacts in low voltage, low current applications, such as in electronic circuits. The device and method feature a flexible spanner that contacts a pair of fixed contacts with a sweeping movement. The spanner includes a bent portion that flexes when a force is exerted on the spanner such that a contact portion of the spanner sweeps across the surface of the pair of fixed contacts.

20 Claims, 5 Drawing Sheets

SLIDE OR RECIPROCATING SWITCH WITH S-SHAPED BRIDGING-OR SPANNER CONTACT

BACKGROUND OF THE INVENTION

The present invention relates generally to switch assemblies. More particularly, the invention relates to a device and method for establishing an electrically conductive path between a pair of contacts in low voltage, low current applications, such as in electronic circuits.

Moveable spanners which selectively bridge a pair of contacts to establish either an open or closed circuit are well known in the art. For example, one such device is a flat spanner stamped from a sheet of brass material. Silver is bonded onto each end of the spanner to form raised regions providing contact points. Thus, when the spanner bridges the pair of contacts, the raised regions touch the contacts and establish a closed circuit. By forming such raised regions on both sides of the brass element, the spanner also can function as a two-position switch. Typically, the flat spanner has two contact points on each side of each end, thus providing a back-up in the event one of the contact points is eroded or obstructed by dirt.

However, the flat spanner has several disadvantages. In particular, the flexibility of the flat spanner is limited. Thus, for example, if a spanner contact point or a circuit contact is obstructed by foreign matter, the limited flexibility can prevent the back-up spanner contact point from completing the circuit. Moreover, the limited flexibility results in undesirable contact bounce when the flat spanner is moved to complete or break the circuit. Further, the flat, inflexible construction does not permit the spanner contact points to sweep across and clean the circuit contacts when completing the circuit. Another disadvantage is that the bonded contact material can corrode after repeated use or due to environmental conditions, thus affecting the reliability and limiting the useful life of the flat spanner.

Another example of a prior art spanner is illustrated in FIG. 1. Spanner 10, which is shown bridging circuit contacts 58, 60, is stamped from a sheet of an alloy material and includes a flat central region 12 and fingers 14–32. The fingers 14–32 include raised regions providing contact regions 34–52. However, the contact regions 34–52 are formed by shaping the sheet metal rather than by a bonding operation. In particular, the sheet metal is bent such that a radius 54 is formed in fingers 14–32. The contact regions 34–52 also are bent to include a radius 56 curving in a direction opposite to radius 56. In prior art spanner 10, the magnitude of radius 56 is approximately double the magnitude of radius 54.

Although fingers 14–32 provide spanner 10 with more flexibility than traditional flat spanners, the flexibility is substantially limited to a direction perpendicular to circuit contacts 58, 60. Thus, spanner 10 suffers from many of the same disadvantages as previously described with respect to the flat spanner. For example, motion of contact points 34–52 in a direction generally parallel to circuit contacts 58, 60 is restricted, preventing contact points 34–52 from sweeping across and cleaning circuit contacts 54–56. As a result, the reliability of spanner 10 is limited.

There is a need, therefore, for a high reliability moveable spanner for use in low voltage, low current applications, such as in electronic circuits. Such a spanner should be able to withstand potentially corrosive environments, while being inexpensive to manufacture relative to a hermetically sealed contact. Additionally, the spanner contact regions should be constructed of a material that minimizes erosion due to repeated use. The spanner contact regions should also flexibly move with respect to the circuit contacts, thus providing the features of minimized contact bounce, circuit contact sweeping, and back-up contact in the event of a foreign matter obstruction.

SUMMARY OF THE INVENTION

The present invention provides an innovative device and method for establishing an electrically conductive path across a pair of contacts in a circuit. The device and method feature a flexible spanner that contacts a pair of contacts with a sweeping movement.

Thus, in accordance with a first aspect of the invention, a switch circuit includes a pair of contacts and a spanner guide assembly that has a spanner plunger and a spanner. The spanner, which extends between the pair of contacts, comprises a central region and a pair of end regions. The central region is disposed in a spanner plane and is in mechanical communication with the spanner plunger. Each of the pair of end regions extends from the central region of the spanner and includes a bent portion and a contact region. The bent portion extends from the spanner plane and is coupled to a contact region located in a contact plane that is below and substantially parallel to the spanner plane. When the spanner plunger exerts a force on the central region of the spanner, the bent portion flexes such that each contact region contacts one of the pair of contacts with a sweeping movement.

According to a second aspect of the invention, a switch circuit includes a pair of contacts and a spanner guide assembly having a spanner plunger and a spanner. The spanner, which extends between the pair of contacts, comprises a central region and a pair of end regions. The central region is disposed in a spanner plane and is in mechanical communication with the spanner plunger. Each of the pair of end regions extends from the central region of the spanner and includes a bent portion and a contact region. The bent portion extends from the spanner plane and is coupled to a contact region located in a contact plane that is below and substantially parallel to the spanner plane. The bent portion includes a bent portion radius and the contact region includes a contact region radius that is substantially equal to the bent portion radius. Thus, when the spanner plunger exerts a force on the central region of the spanner, the bent portion flexes such that each contact region contacts one of the pair of contacts with a sweeping movement.

In accordance with a third aspect of the invention, a switch circuit includes first and second pairs of contacts and a spanner guide assembly having a spanner plunger and a spanner. A central region of the spanner is disposed in a spanner plane and is in mechanical communication with the spanner plunger. A pair of end regions extends from the central region and includes a plurality of fingers. Each of the fingers comprises a bent portion and a contact portion. The bent portion extends between the spanner plane and a first contact plane positioned above and substantially parallel to the spanner plane. The contact portion, which extends from the bent portion, is configured to form first and second contact regions. The first contact region is disposed in the first contact plane, and the second contact region is disposed in a second contact plane which is positioned below and substantially parallel to the spanner plane. When the spanner plunger is in a first position, the first pair of contacts touches the first contact plane. Likewise, when the spanner plunger is in a second position, the second pair of contacts touches the second contact plane.

In accordance with a further aspect of the invention, an electrically conductive path is established between a pair of stationary contacts in a switch circuit having a spanner plunger and a spanner. A force is exerted on the spanner plunger to urge the spanner into contact with the pair of stationary contacts. A pair of bent regions of the spanner adjacent to the pair of stationary contacts is flexed, and a plurality of contact regions of the spanner are swept across the pair of stationary contacts.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Figure 1:
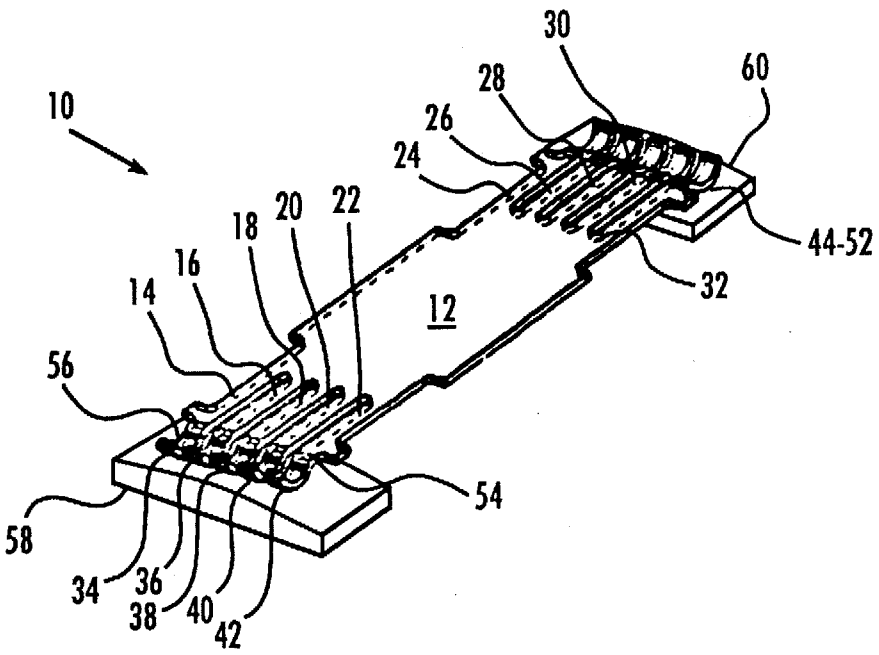
FIG. 1 PRIOR ART
FIG. 1 is an overall perspective view of an embodiment of a prior art spanner, illustrating the spanner in contact with a pair of stationary contacts.
Figure 3:
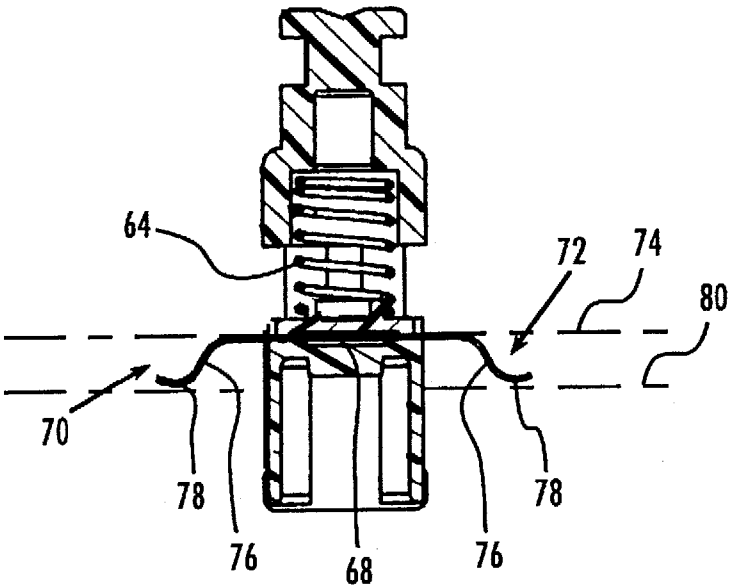
FIG. 3 is a sectional view of the spanner guide assembly illustrated in FIG. 2 along the line 3—3.
Figure 2:
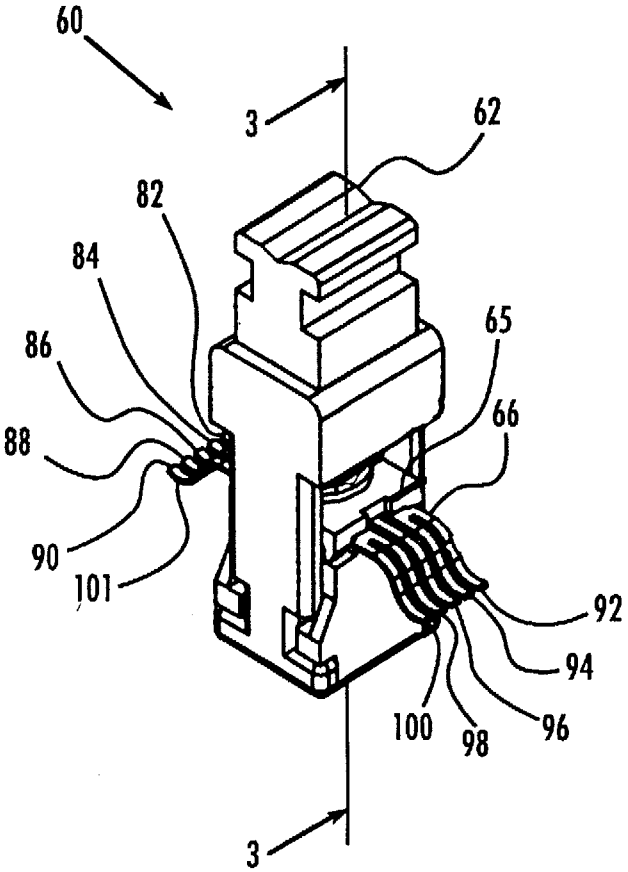
FIG. 2 is an overall perspective view of a normally open spanner guide assembly including an exemplary embodiment of a spanner.

Turning now to the figures and referring specifically to FIGS. 2 and 3, a normally open spanner guide assembly 60 for use in low voltage, low current electronic circuit applications is illustrated. Assembly 60 includes a plunger 62, a plunger spring 64, a spanner carrier 65, and a spanner 66. When spring 64 is not being compressed as depicted in FIG. 3, assembly 60 is in a normally open state. That is, spanner 66 does not establish an electrically conductive path in a circuit. When spring 64 is compressed by pressure exerted on plunger 62, spanner 66 is urged into a position to close the electrically conductive path between a pair of contacts (not shown) as will be described in greater detail below. Spanner carrier 65 shields spanner 66 from plunger 62 to reduce wear and prevent the production of debris.

In the preferred embodiment illustrated, spanner 66 includes a central region 68 and a pair of end regions 70 and 72. Central region 68 is substantially flat and is disposed in a spanner plane 74. End regions 70, 72, which extend from central region 68, each include a bent portion 76 and a contact region 78. Contact region 78 is disposed in a contact plane 80 which is located below and substantially parallel to spanner plane 74. As shown, bent portion 76 extends between spanner plane 74 and contact plane 80.

Figure 4:
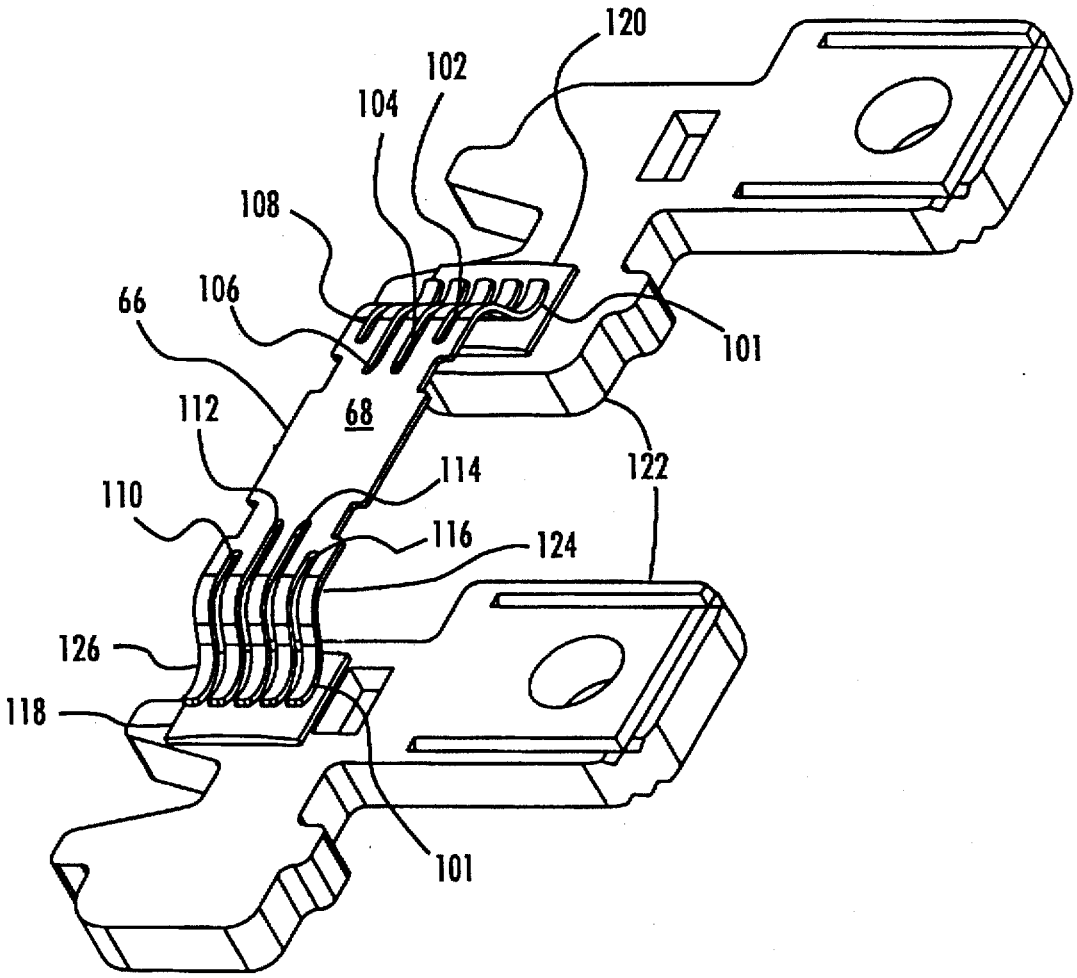
FIG. 4 is an overall perspective view of an exemplary application in which the embodiment of the spanner of FIG. 2 is in contact with a pair of fixed contacts.

To enhance the flexibility of spanner 66, end regions 70, 72 preferably comprise a plurality of fingers 82–100, each having a contact point 101. Although in the preferred embodiment, end regions 70, 72 each include five fingers, other applications may use a fewer or a greater number of fingers. As best shown in FIG. 4, fingers 82–100 are separated by slots 102–116. To further enhance flexibility, slots 102–116 extend through end region 70, 72 into central region 68. In the preferred embodiment, fingers 82–100 have non-uniform lengths. For example, fingers 86 and 96 which are centrally located are longer than the outer fingers. This feature permits center fingers 86 and 96 to more easily flex. Although the configuration of fingers 82–100 and slots 102–116 as shown is preferred, other configurations are possible. For example, slots 102–116 may not extend all the way into central region 68. However, decreasing the length of fingers 82–100 will sacrifice flexibility.

The enhanced flexibility provided by the preferred configuration of fingers 82–100 and slots 102–116 offers several advantages as may best be explained with reference to FIG. 4. FIG. 4 illustrates an exemplary application in which spanner 66 is used to establish an electrically conductive path between a pair of stationary contacts 118, 120 positioned on a surface 122 in an electronic circuit. When a force is exerted on central region 68 of spanner 66, such as by plunger 62, spanner 66 moves such that contact points 101 of fingers 82–100 touch stationary contacts 118, 120. In the event that contact point 101 of one of fingers 82–100 is prevented from touching the surface of contacts 118, 120 because of an obstruction by a foreign material, such as dirt or other debris, the flexibility of spanner 66 will permit the remaining fingers 82–100 to complete the contact.

In addition to ensuring that at least some of fingers 82–100 make contact with stationary contacts 118, 120, the flexibility of spanner 66 also advantageously allows fingers 82–100 to wipe the surface of contacts 118, 120. That is, once contact points 101 touch stationary contacts 118, 120, the force exerted on central region 68 causes fingers 82–100 to flex such that contact points 101 are urged across stationary contacts 118, 120 with a sweeping movement. Accordingly, in the event the surfaces of contacts 118, 120 are obstructed by foreign matter, such as dirt, corrosion, or a film, contact points 101 of fingers 82–100 can sweep across the surface of contacts 118, 120 with sufficient force to clear such matter and ensure a good contact.

Flexible fingers 82–100 provide another advantageous feature. As illustrated in FIG. 4, the surface of contacts 118, 120 are radiused in a direction that curves away from contact plane 80. Accordingly, the contact points 101 of each of fingers 82–100 do not touch the surface of contacts 118, 120 at the same time. Because of the non-simultaneous touching, contact bounce is minimized when spanner 66 is moved in and out of contact with stationary contacts 118, 120.

In the preferred embodiment, spanner 66 is stamped from an alloy material, such as 0.0075 inch thick paliney 6 alloy, which includes a nobel metal. Bent portion 76 and contact region 78 are shaped to include a bent portion radius 124 and a contact region radius 126. Radii 124, 126 have substantially equal magnitudes, preferably within 20 percent, and curve in opposite directions. For example, in a preferred embodiment, radii 124, 126 each have a magnitude of 0.048 inch. However, as readily envisioned by one skilled in the art, other configurations are possible to provide the desired flexibility.

As discussed above, spanner 66 is stamped from an alloy material. The alloy material preferably includes a precious metal, such as gold or silver, to optimize conductivity of contact points 101. Because of the alloy material, contact points 101 will not easily corrode due to environmental conditions. In alternate embodiments, however, spanner 66 may be constructed from other conductive material, such as brass, and contact points 101 may be raised regions formed by bonding a metal, such as silver, onto the brass.

Figure 6:
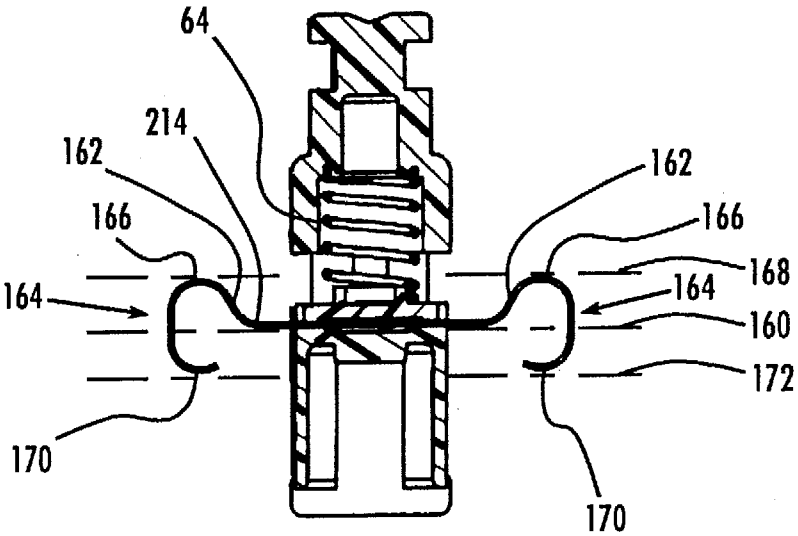
FIG. 6 is a sectional view of the spanner guide assembly illustrated in FIG. 5 along the line 6—6.
Figure 5:
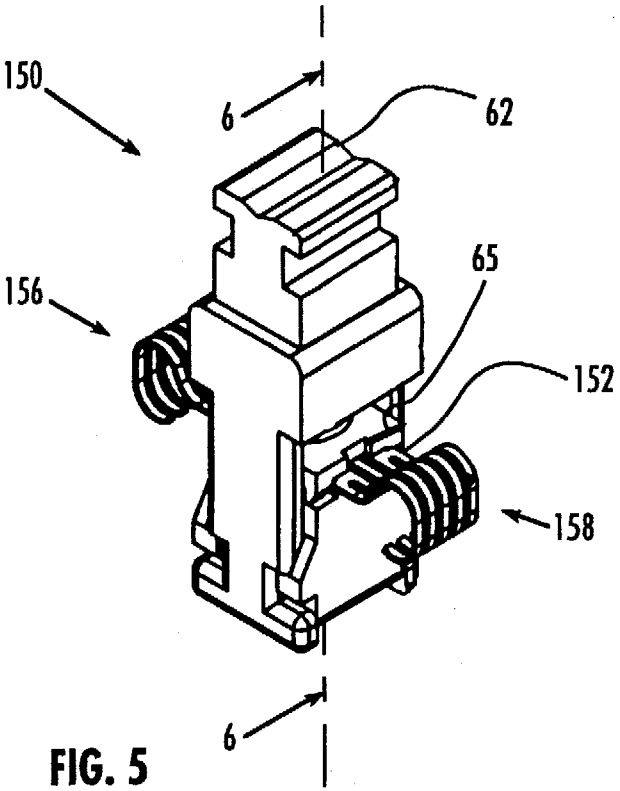
FIG. 5 is an overall perspective view of a normally open/normally closed spanner guide assembly including an alternate embodiment of a spanner.

Referring now to FIGS. 5 and 6, a normally open/normally closed spanner guide assembly 150 is illustrated. Assembly 150 includes a plunger 62, a plunger spring 64, a spanner carrier 65, and a spanner 152. When spring 64 is not compressed as depicted in FIG. 6, spanner 152 establishes an electrically conductive path between a first pair of contacts (not shown). When spring 64 is compressed by pressure exerted on plunger 62, spanner 152 is urged into a position to establish an electrically conductive path between a second pair of contacts (not shown). Thus, assembly 150 functions as a two-position switch. Spanner carrier 65 shields spanner 152 from plunger 62 to reduce wear and prevent the production of debris.

Figure 7:
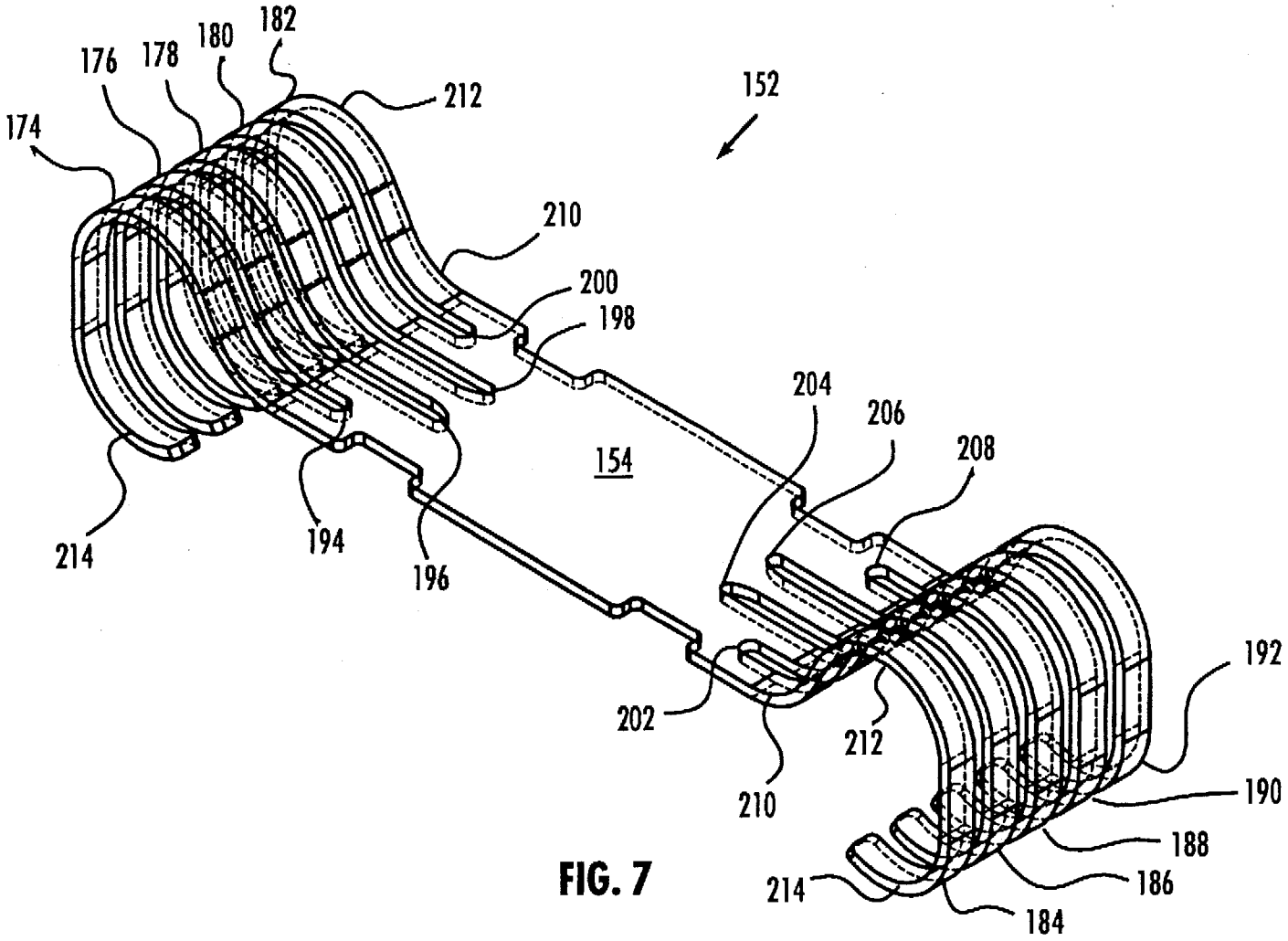
FIG. 7 is an overall perspective view of the spanner included in FIG. 5.

In the preferred embodiment illustrated in FIGS. 5–7, spanner 152 includes a central region 154 and a pair of end regions 156 and 158. Central region 154 is substantially flat and is disposed in a spanner plane 160. End regions 156, 158, which extend from central region 154, each include a bent portion 162 and a contact portion 164. Contact portion 164 is configured to form a first contact region 166 disposed in a first contact plane 168 and a second contact region 170 disposed in a second contact plane 172. Bent portion 162 extends between spanner plane 160 and first contact plane 168 which is disposed above and substantially parallel to spanner plane 160. Similarly, second contact plane 172 is disposed below and substantially parallel to spanner plane 160.

When establishing an electrically conductive path between a pair of contacts, spanner 152 works in a manner substantially similar to that previously described with respect to spanner 66. That is, a force exerted on central region 154 by plunger 62 causes second contact region 170 to sweep across the surface of a second pair of contacts (not shown). Similarly, when the force is removed from central region 154, first contact region 166 sweeps across a first pair of contacts (not shown).

Spanner 152 includes features and advantages similar to those previously described with respect to spanner 66. For example, end regions 156, 158 of spanner 154 preferably comprise a plurality of fingers 174–192 separated by slots 194–208. In addition, fingers 174–192 have non-uniform lengths and slots 194–208 extend into central region 154. Although the configuration of spanner 152 as illustrated in FIGS. 5–7 is preferred, other configurations of end regions 156, 158 including fingers 174–192 and slots 194–208 are possible. For example, other applications may use a fewer or a greater number of fingers, the length of the fingers may be uniform, and the slots may not extend all the way into the central region of the spanner.

As discussed with respect to spanner 66, the preferred configuration illustrated in FIGS. 5–7 enhances the flexibility of spanner 152. Spanner 152 thus offers the advantages of back-up contact in the event of an obstruction by dirt or debris, sweeping contact which cleans the surfaces of the pair of stationary contacts, as well as minimized contact bounce when making or breaking the conductive path.

Spanner 152 preferably is stamped from an alloy material, such as 0.0075 inch thick paliney 6 alloy, which preferably includes a precious metal, such as gold or silver. Bent portion 162 and contact portion 164 are configured to include a bent portion radius 210 and contact portion radii 212, 214. Radii 210, 212, and 214 have substantially equal magnitudes (0.048 inch, 0.055 inch and 0.055 inch, respectively), preferably within 20 percent. However, other configurations of bent portion 162 and contact portion 164 are possible as readily envisioned by one skilled in the art. For example, the absolute and relative magnitudes of radii 210–214 may vary. Alternatively, contact portion 164 may include substantially flat contact regions rather than radiused contact regions While the embodiments illustrated in the figures and described above are presently preferred, it should be understood that these embodiments are offered by way of example only. The invention is not intended to be limited to any particular embodiment, but is intended to extend to various modifications that nevertheless fall within the scope of the appended claims.

What is claimed is:

1. In a switch circuit having a pair of contacts and a spanner guide assembly, the spanner guide assembly including a spanner plunger and a spanner extending between the contacts, the spanner comprising:

a central region disposed in a spanner plane, the central region being in mechanical communication with the spanner plunger;

a pair of end regions extending from the central region, each of the end regions including:

a bent portion extending between the spanner plane and a contact plane, the contact plane being below and substantially parallel to the spanner plane; and a contact region coupled to the bent portion, the contact region being disposed in the contact plane, wherein when the spanner plunger exerts a force on the central region, the bent portion flexes such that the contact region contacts one of the pair of contacts with a sweeping movement.

2. The spanner as recited in claim 1, wherein the contact region comprises a plurality of fingers separated by slots, each of the plurality of fingers having a contact point disposed in the contact plane, wherein the force exerted upon the central region by the spanner plunger causes the contact points to contact one of the pair of contacts with a sweeping movement.

3. The spanner as recited in claim 2, wherein the pair of contacts is configured such that each of the contact points touch one of the pair of contacts in a sequential order.

4. The spanner as recited in claim 2, wherein the slots extend into the central region of the spanner.

5. The spanner as recited in claim 2, wherein the plurality of fingers have nonuniform lengths.

6. The spanner as recited in claim 2, wherein the plurality of fingers is five fingers.

7. The spanner as recited in claim 1, wherein the spanner is stamped from an alloy material.

8. The spanner as recited in claim 7, wherein the alloy material includes a precious metal.

9. In a switch circuit having a pair of contacts and a spanner guide assembly, the spanner guide assembly including a spanner plunger and a spanner extending between the contacts, the spanner comprising:

a central region disposed in a spanner plane, the central region being in mechanical communication with the spanner plunger;

a pair of end regions extending from the central region, each of the end regions including:

a bent portion having a bent portion radius, the bent portion extending between the spanner plane and a contact plane, the contact plane being below and substantially parallel to the spanner plane; and a contact region coupled to the bent portion, the contact region being disposed in the contact plane and having a contact region radius, wherein the contact region radius is substantially equal to the bent portion radius, whereby when the spanner plunger exerts a force on the central region, the bent portion flexes such that the contact region contacts one of the pair of contacts with a sweeping movement.

10. The spanner as recited in claim 9, wherein the contact region comprises a plurality of fingers and the pair of contacts is configured such that each of the plurality of fingers touches one of the pair of contacts in a sequential order.

11. In a switch circuit having first and second pairs of contacts and a spanner guide assembly, the spanner guide assembly including a spanner plunger and a spanner, the spanner comprising:

a central region disposed in a spanner plane, the central region being in mechanical communication with the spanner plunger;

a pair of end regions extending from the central region, each of the end regions including a plurality of fingers, each of the plurality of fingers comprising:

a bent portion extending between the spanner plane and a first contact plane, the first contact plane being above and substantially parallel to the spanner plane;

a contact portion extending from the bent portion, the contact portion configured to form a first contact region disposed in the first contact plane and a second contact region disposed in a second contact plane, the second contact plane being below and substantially parallel to the spanner plane, wherein the first pair of contacts touches the first contact plane when the spanner plunger is in a first position and the second pair of contacts touches the second contact plane when the spanner plunger is in a second position.

12. The spanner as recited in claim 11, wherein when the spanner plunger exerts a force on the central region, the bent portion flexes such that the second contact region contacts one of the second pair of contacts with a sweeping movement.

13. The spanner as recited in claim 12, wherein the first and second pair of stationary contacts are configured such that each of the first contact regions touches one of the first pair of contacts in a sequential order and each of the second contact regions touches one of the second pair of contacts in a sequential order.

14. The spanner as recited in claim 11, wherein the spanner is stamped from an alloy material.

15. The spanner as recited in claim 14, wherein the alloy material includes a precious metal.

16. The spanner as recited in claim 11, wherein the bent portion has a bent portion radius and the contact portion has a contact portion radius, the contact portion radius being substantially equal to the bent portion radius.

17. The spanner as recited in claim 11, wherein the plurality of fingers are separated by slots, the slots extending into the central region.

18. The spanner as recited in claim 11, wherein the plurality of fingers have nonuniform lengths.

19. In a switch circuit having a pair of contacts and a spanner guide assembly, the spanner guide assembly including a spanner plunger and a spanner extending between the pair of contacts, the spanner comprising:

a central region disposed in a spanner plane, the central region being in mechanical communication with the spanner plunger;

a pair of end regions extending from the central region, each of the pair of end regions having an s-shape and including:

a bent portion extending between the spanner plane and a contact plane, the contact plane being below and substantially parallel to the spanner plane; and a contact region coupled to the bent portion, the contact region being disposed in the contact plane, wherein when the spanner plunger exerts a force on the central region, the bent portion flexes such that the contact region contacts one of the pair of contacts with a sweeping movement.

20. The spanner as recited in claim 19, wherein the s-shape includes a first radius and a second radius having substantially equal magnitudes.

* * * * *